US006244550B1

(12) United States Patent
Blatchford

(10) Patent No.: US 6,244,550 B1
(45) Date of Patent: Jun. 12, 2001

(54) DEVICE FOR HOLDING A FACE MASK

(76) Inventor: Jeffrey K. Blatchford, 1412 9th St., Onawa, IA (US) 51040

( * ) Notice: Subject to any disclaimer, the term of this patent is extended or adjusted under 35 U.S.C. 154(b) by 0 days.

(21) Appl. No.: 09/502,306

(22) Filed: Feb. 11, 2000

(51) Int. Cl.[7] ..... A47F 7/00
(52) U.S. Cl. ..... 248/222.52; 403/348; 248/309.2
(58) Field of Search ..... 248/309.1, 309.2, 248/220.22, 222.52, 224.8, 225.11, 231.91, 551; 269/53; 403/348, 349

(56) References Cited

U.S. PATENT DOCUMENTS

| | | | | |
|---|---|---|---|---|
| D. 374,366 | | 10/1996 | Eldon, III et al. | D6/567 |
| 1,838,935 | * | 12/1931 | Fixsen | 248/222.52 |
| 3,180,606 | * | 4/1965 | Sabin et al. | 248/239 |
| 3,229,944 | | 1/1966 | Everburg | 248/220.31 |
| 3,443,783 | * | 5/1969 | Fisher | 248/239 |
| 3,733,043 | | 5/1973 | Binns et al. | 248/222.13 |
| 4,006,877 | * | 2/1977 | Van Niel | 248/466 |
| 4,125,339 | * | 11/1978 | Pittinger, Sr. et al. | 403/348 |
| 4,133,560 | * | 1/1979 | Ishikawa et al. | 285/81 |
| 4,505,448 | | 3/1985 | Massie | 248/313 |
| 4,527,760 | * | 7/1985 | Salacuse | 248/108 |
| 4,624,397 | | 11/1986 | Muto | 224/553 |
| 4,963,921 | | 10/1990 | Kariya et al. | 355/53 |
| 4,979,713 | * | 12/1990 | Bell | 248/224.3 |
| 5,188,324 | * | 2/1993 | Joseph et al. | 248/222.52 |
| 5,626,435 | * | 5/1997 | Wohlhüter | 403/348 |

* cited by examiner

*Primary Examiner*—Ramon O. Ramirez
*Assistant Examiner*—Jon Szumny

(57) ABSTRACT

A device for holding a face mask for mounting to a fire truck. The device for holding a face mask includes a base for mounting on a surface and an upstanding member. The base has a top face, and a bottom face for placing against the surface. At least one bore is located in the top face of the base and extends through the bottom face of the base. At least one screw secures the base to the surface. An upstanding member is attached to the base. The upstanding member comprises a pillar and a table. The pillar is fixedly mounted to the top face of the base. The table is fixedly coupled to the pillar such that the pillar is between the base and the table. The table has two opposing generally straight side portions and two opposing arcuate side portions.

11 Claims, 2 Drawing Sheets

DEVICE FOR HOLDING A FACE MASK

BACKGROUND OF THE INVENTION

1. Field of the Invention

The present invention relates to mask holders and more particularly pertains to a new device for holding a face mask for mounting to a fire truck.

2. Description of the Prior Art

The use of mask holders is known in the prior art. More specifically, mask holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,963,921; U.S. Pat. No. 4,505,448; U.S. Pat. No. 3,733,043; U.S. Pat. No. 4,624,397; U.S. Pat. No. 3,229,944; and U.S. Pat. Des. No. 374,366.

While these devices fulfill their respective, particular objectives and requirements, the aforementioned patents do not disclose a new device for holding a face mask. The inventive device includes a base for mounting on a surface and an upstanding member. The base has a top face, and a bottom face for placing against the surface. At least one bore is located in the top face of the base and extends through the bottom face of the base. At least one screw secures the base to the surface. An upstanding member is attached to the base. The upstanding member comprises a pillar and a table. The pillar is fixedly mounted to the top face of the base. The table is fixedly coupled to the pillar such that the pillar is between the base and the table. The table has two opposing generally straight side portions and two opposing arcuate side portions.

In these respects, the device for holding a face mask according to the present invention substantially departs from the conventional concepts and designs of the prior art, and in so doing provides an apparatus primarily developed for the purpose of mounting to a fire truck.

SUMMARY OF THE INVENTION

In view of the foregoing disadvantages inherent in the known types of mask holders now present in the prior art, the present invention provides a new device for holding a face mask construction wherein the same can be utilized for mounting to a fire truck.

The general purpose of the present invention, which will be described subsequently in greater detail, is to provide a new device for holding a face mask apparatus and method which has many of the advantages of the mask holders mentioned heretofore and many novel features that result in a new device for holding a face mask which is not anticipated, rendered obvious, suggested, or even implied by any of the prior art mask holders, either alone or in any combination thereof.

To attain this, the present invention generally comprises a base for mounting on a surface and an upstanding member. The base has a top face, and a bottom face for placing against the surface. At least one bore is located in the top face of the base and extends through the bottom face of the base. At least one screw secures the base to the surface. An upstanding member is attached to the base. The upstanding member comprises a pillar and a table. The pillar is fixedly mounted to the top face of the base. The table is fixedly coupled to the pillar such that the pillar is between the base and the table. The table has two opposing generally straight side portions and two opposing arcuate side portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for holding a face mask apparatus and method which has many of the advantages of the mask holders mentioned heretofore and many novel features that result in a new device for holding a face mask which is not anticipated, rendered obvious, suggested, or even implied by any of the prior art mask holders, either alone or in any combination thereof.

It is another object of the present invention to provide a new device for holding a face mask which may be easily and efficiently manufactured and marketed.

It is a further object of the present invention to provide a new device for holding a face mask which is of a durable and reliable construction.

An even further object of the present invention is to provide a new device for holding a face mask which is susceptible of a low cost of manufacture with regard to both materials and labor, and which accordingly is then susceptible of low prices of sale to the consuming public, thereby making such device for holding a face mask economically available to the buying public.

Still yet another object of the present invention is to provide a new device for holding a face mask which provides in the apparatuses and methods of the prior art some of the advantages thereof, while simultaneously overcoming some of the disadvantages normally associated therewith.

Still another object of the present invention is to provide a new device for holding a face mask for mounting to a fire truck.

Yet another object of the present invention is to provide a new device for holding a face mask which includes a base for mounting on a surface and an upstanding member. The base has a top face, and a bottom face for placing against the surface. At least one bore is located in the top face of the base and extends through the bottom face of the base. At least one screw secures the base to the surface. An upstanding member is attached to the base. The upstanding member comprises a pillar and a table. The pillar is fixedly mounted to the top face of the base. The table is fixedly coupled to the pillar such that the pillar is between the base and the table. The table has two opposing generally straight side portions and two opposing arcuate side portions.

Still yet another object of the present invention is to provide a new device for holding a face mask that will securely hold a face mask on the wall of a compartment inside a fire truck to prevent damage to the face mask. The device can also hold a mask in places such as lockers, storage areas, fire stations, ambulances, or any possible emergency vehicle or area where a mask should be accessible.

Even still another object of the present invention is to provide a new device for holding a face mask that is easily accessible and will allow easy removal and mounting of face masks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
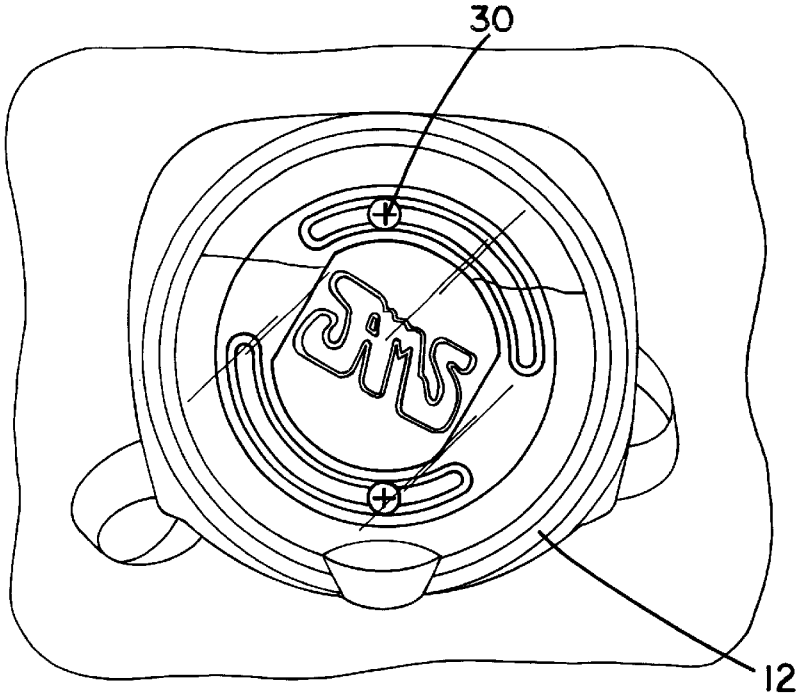
FIG. 1 is a schematic plan view of a new device for holding a face mask including a face mask according to the present invention.
Figure 2:
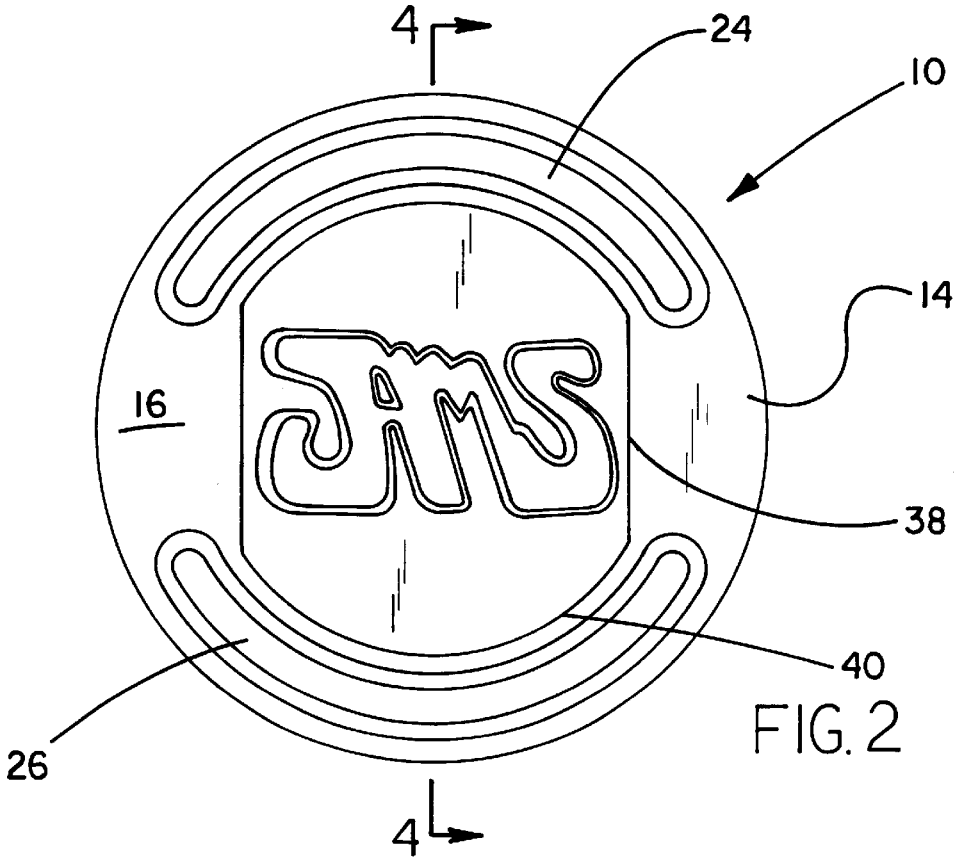
FIG. 2 is a schematic plan view of the present invention.
Figure 3:
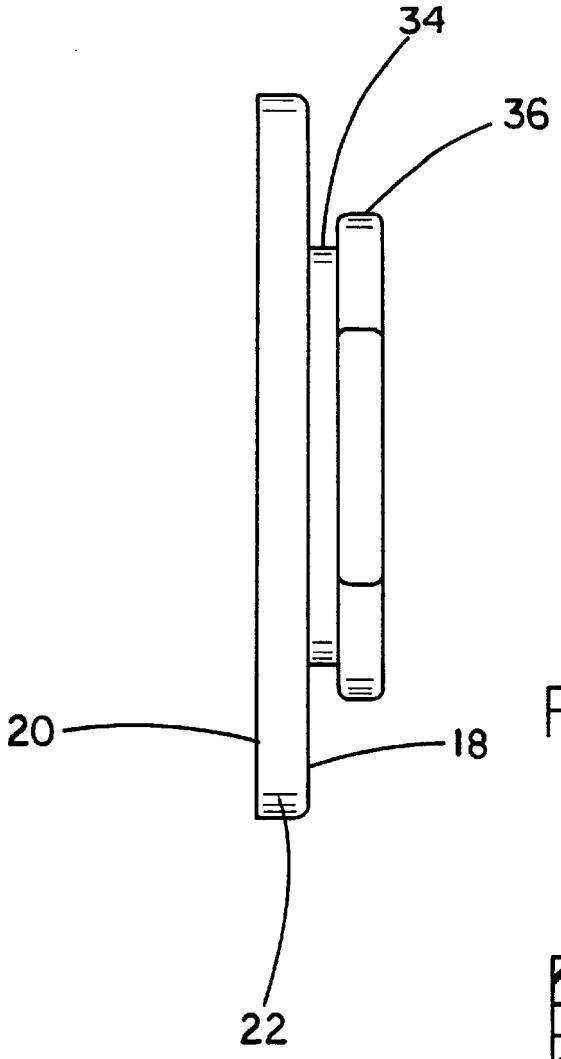
FIG. 3 is a schematic side view of the present invention.
Figure 4:
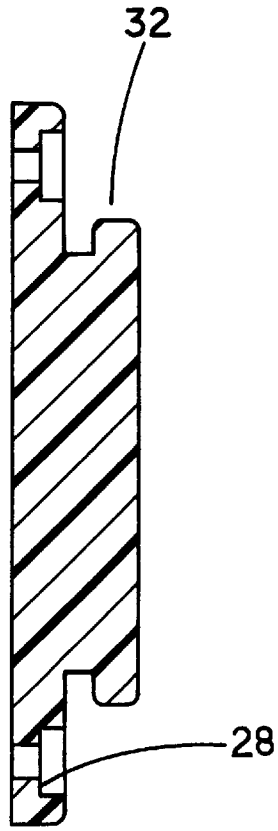
FIG. 4 is a schematic cross-sectional side view taken along line 4—4 of the present invention.

With reference now to the drawings, and in particular to FIGS. 1 through 4 thereof, a new device for holding a face mask embodying the principles and concepts of the present invention and generally designated by the reference numeral 10 will be described.

As best illustrated in FIGS. 1 through 4, the device for holding a face mask 10 generally comprises a face mask 12 and a face mask holder 14. The face mask 12 has a portion thereon for receiving an aspirator. Face masks having aspirator connections are well known in the art.

A base 16 for mounting on a surface has a top face 18, a bottom face 20 for placing against the surface and a peripheral edge 22. The top face 18 and the bottom face 20 are generally planar. The base 16 has a generally circular shape. Preferably, the base 16 has a diameter greater than two and one-fourth inches for reasons which become apparent. Ideally, the base has a diameter greater than three inches.

A first slot 24 and a second slot 26 are located in the top face 18 of the base 16, though a bore can be substituted in their place. Each of the slots 24, 26 extends through the base 16 to the bottom face 20. The slots are wider adjacent to the top face 18 than adjacent to the bottom face 20. A shoulder 28 is defined within the slot. The first 24 and second 26 slots are generally adjacent to the peripheral edge 22. Ideally, the first and second slots are generally arcuate. The first and the second slots are located in generally opposite locations of the base 16.

A pair of screws 30 secure the base to the surface. One of the screws is in each of the slots 24, 26.

An upstanding member 32 is attached to the base. The upstanding member 32 comprises a pillar 34 and a table 36.

The pillar 34 is fixedly mounted to the top face 18 of the base 16, and is generally located on a medial portion of the base. Preferably, the pillar 34 has a generally circular shape. Ideally the pillar has a diameter less than about two inches. This diameter combined with a larger base 16 diameter allows the screws 30 to be exposed. Ideally, the pillar 34 has a height substantially equal to one-eighth of an inch. This height is substantially equal to the securing edge of an aspirator, and as such, is the height of the securing portion of the face mask.

The table 36 is fixedly coupled to the pillar 34 such that the pillar 34 is between the base 16 and the table 36. The table 36 has two opposing generally straight side portions 38 and two opposing arcuate side portions 40. The opposing straight side portions 38 are oriented generally parallel to each other. The table 36 has a greatest width from the arcuate side portion 40 to arcuate side portion. Ideally this greatest width is equal to two and one-fourth inches. The table has a shortest width from one opposing straight side portion 38 to the other opposing straight side portion. Ideally, this shortest width is equal to one and seven-eighths inch. Preferably, the table has a height substantially equal to one-fourth of an inch. The measurements of the table are again related to the coupling apparatus of an aspirator.

In use, the aspirator receiving portion of a face mask may be placed over the table and turned such that an edge of the receiving portion is wedged between the table and the base. The base is secured to the inside wall of an emergency vehicle, primarily fire trucks or wherever easy access is required. In a second embodiment, not shown, no base is used and the aspirating portion of a face mask is wedged between the table and the surface to which the table is attached. The second embodiment has only the pillar and table with a bore extending through the table and pillar. A screw extends through the bore and holds the pillar and table to a surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for holding a face mask on a surface, comprising:

a base for mounting on a surface, said base having a top face and a bottom face for placing against said surface;

at least one bore, said bore being located in said top face of said base and extending through said bottom face of said base;

at least one screw for securing said base to said surface, said screw being inserted in said bore;

an upstanding member attached to said base, said upstanding member comprising:

a pillar, said pillar being fixedly mounted to said top face of said base; and a table, said table being fixedly coupled to said pillar such that said pillar is between said base and said table, said table having two opposing generally straight side portions and two opposing arcuate side portions;

said base having a peripheral edge, said top face and said bottom face being generally planar, said base having a generally circular shape; and wherein said bores comprise a first slot and a second slot, said slots comprising:

each of said slots being located in said top face of said base, each of said slots extending through said base to said bottom face, each of said slots being wider adjacent to said top face than adjacent to said bottom face, wherein a shoulder is defined within said slot, said first and second slot being generally adjacent to said peripheral edge, said first and second slots being generally arcuate, said first and said second slots being located in generally opposite locations of said base.

2. The device for holding a face mask on a surface as defined in claim 1, wherein said pillar comprises:

said pillar being generally located on a medial portion of said base, said pillar having a generally circular shape, wherein said pillar has a diameter less than about two inches, said pilar having a height substantially equal to one-eight of an inch.

3. The device for holding a face mask on a surface as defined in claim 1, wherein said table comprises:

said opposing straight side portions being oriented generally parallel to each other, wherein said table has a greatest width from said arcuate side portion to arcuate side portion equal to two and one-fourth inches, wherein said table has a shortest width from one opposing straight side portion to the other opposing straight side portion equal to one and seven-eights inch, said table having a height substantially equal to one-fourth of an inch.

4. The device for holding a face mask on a surface as defined in claim 1, further comprising:

wherein an aspirator receiving portion of a face mask may be placed over said table and turned such that an edge of said receiving portion is wedged between said table and said base.

5. The device for holding a face mask on a surface as defined in claim 1, further comprising:

wherein an aspirator receiving portion of a face mask may be placed over said table and turned such that

6. A device for holding a face mask on a surface, comprising:

a face mask, said face mask having a portion thereon for receiving an aspirator;

a base for mounting on a surface, said base having a top face, a bottom face for placing against said surface and a peripheral edge, said top face and said bottom face being generally planar, said base having a generally circular shape;

a first slot and a second slot, each of said slots being located in said top face of said base, each of said slots extending through said base to said bottom face, each of said slots being wider adjacent to said top face than adjacent to said bottom face, wherein a shoulder is defined within said slot, said first and second slot being generally adjacent to said peripheral edge, said first and second slots being generally arcuate, said first and said second slots being located in generally opposite locations of said base, said base having a diameter greater than three and one-half inches;

a pair of screws for securing said base to said surface, one of said screws being in each of said slots;

an upstanding member attached to said base, said upstanding member comprising:

a pillar, said pillar being fixedly mounted to said top face of said base, said pillar being generally located on a medial portion of said base, said pillar having a generally circular shape, wherein said pillar has a diameter less than about two inches, said pillar having, a height substantially equal to one-eighth of an inch;

a table, said table being fixedly coupled to said pillar such that said pillar is between said base and said table, said table having two opposing generally straight side portions and two opposing arcuate side portions, said opposing straight side portions being oriented generally parallel to each other, wherein said table has a greatest width from said arcuate side portion to arcuate side portion equal to two and one-fourth inches wherein said table has a shortest width from one opposing straight side portion to the other opposing straight side portion equal to one and seven-eighths inch, said table having a height substantially equal to one-fourth of an inch; and wherein an aspirator receiving portion of a face mask may be placed over said table and turned such that an edge of said receiving portion is wedged between said table and said base.

7. A device for holding a face mask on a surface, comprising:

a base for mounting on a surface, said base having a top face and a bottom face for placing against said surface;

at least one bore, said bore being located in said top face of said base and extending through said bottom face of said base;

at least one screw for securing said base to said surface, said screw being inserted in said bore;

an upstanding member attached to said base, said upstanding member comprising:

a pillar, said pillar being fixedly mounted to said top face of said base; and a table, said table being fixedly coupled to said pillar such that said pillar is between said base and said table, said table having two opposing generally straight side portions and two opposing arcuate side portions;

said opposing straight side portions being oriented generally parallel to each other, wherein said table has a greatest width from said arcuate side portion to arcuate side portion equal to two and one-fourth inches, wherein said table has a shortest width from one opposing straight side portion to the other opposing straight side portion equal to one and seven-eighths inch, said table having a height substantially equal to one-fourth of an inch.

8. The device of claim 7, wherein said base has a peripheral edge, said top face and said bottom face being generally planar, said base having a generally circular shape.

9. The device of claim 8, wherein said bores comprise a first slot and a second slot, said slots comprising:

each of said slots being located in said top face of said base, each of said slots extending through said base to said bottom face, each of said slots being wider adjacent to said top face than adjacent to said bottom face, wherein a shoulder is defined within said slot, said first and second slot being generally adjacent to said peripheral edge, said first and second slots being generally arcuate, said first and said second slots being located in generally opposite locations of said base.

10. The device for holding a face mask on a surface as defined in claim 7, wherein said pillar is generally located on a medial portion of said base, said pillar having a generally circular shape, wherein said pillar has a diameter less than about two inches, said pillar having a height substantially equal to one-eighth of an inch.

11. The device for holding a face mask on a surface as defined in claim 7, wherein an aspirator receiving, portion of a face mask may be placed over said table and turned such that an edge of said receiving portion is wedged between said table and said base.

* * * * *